US007382394B2

(12) United States Patent
Niland et al.

(10) Patent No.: US 7,382,394 B2
(45) Date of Patent: Jun. 3, 2008

(54) SYSTEM AND METHOD FOR CORRECTING SCAN POSITION ERRORS IN AN IMAGING SYSTEM

(75) Inventors: M. Joseph Niland, Dracut, MA (US); David J. Connor, Hollis, NH (US); Donald E. Troxel, Belmont, MA (US); John L. Connolly, III, Newton, NH (US)

(73) Assignee: ECRM Incorporated, Tewksbury, MA (US)

( * ) Notice: Subject to any disclaimer, the term of this patent is extended or adjusted under 35 U.S.C. 154(b) by 490 days.

(21) Appl. No.: 11/087,714

(22) Filed: Mar. 24, 2005

(65) Prior Publication Data

US 2006/0232661 A1 Oct. 19, 2006

(51) Int. Cl.
*B41J 2/435* (2006.01)

(52) U.S. Cl. ..... 347/249

(58) Field of Classification Search ..... 347/234–235, 347/248–250, 116; 708/276
See application file for complete search history.

(56) References Cited

U.S. PATENT DOCUMENTS 4,935,891 A * 6/1990 Curry ..... 708/276
5,910,651 A 6/1999 Ryvkin
6,178,031 B1 1/2001 Rauch et al.
6,351,277 B1 2/2002 Skillman
6,700,600 B1 3/2004 Sandstrom et al.

FOREIGN PATENT DOCUMENTS

JP 11167081 A * 6/1999
JP 2000263841 A * 9/2000

OTHER PUBLICATIONS

Analog Devices. "400 MSPS 14-Bit, 1.8 V CMOS Direct Digital Synthesizer," AD9954, Analog Devices, Inc., 2003. pp. 1-36.

* cited by examiner

*Primary Examiner*—Hai C Pham
(74) *Attorney, Agent, or Firm*—Howard J. Greenwald

(57) ABSTRACT

Embodiments of the invention provide systems and methods for correcting scan position errors in an imaging system. In one embodiment of the present invention, the method includes determining an image beam velocity error as a function of a position within a scan line of an image, and using the image beam velocity error to determine a plurality of pixel clock frequencies to be respectively applied to a plurality of positions within the scan line.

8 Claims, 6 Drawing Sheets

SYSTEM AND METHOD FOR CORRECTING SCAN POSITION ERRORS IN AN IMAGING SYSTEM

BACKGROUND OF THE INVENTION

1. Field of the Invention

The present invention generally relates to systems and methods for correcting scan position errors in an imaging system.

2. Background Description

FIG. 1, generally at 100, is an illustration of a known flat field scanning system in which images can be plotted on a suitable medium, such as photosensitive material 132, from an electrical signal, such as an externally applied video signal 90 of the image. Video signal 90 modulates a power source such as laser driver 95, which, in turn, drives light source 110. Light source 110 converts video signal 90 into an image modulated visible or infrared light output that is collimated by lens 112 to form an image modulated light beam 115. Image modulated light beam 115 may be visible, infrared, or ultraviolet light and is generated by a laser, such as a helium neon laser or a semiconductor laser diode. Image modulated light beam 115 is deflected by a rotatable mirror 120 having, for example, a 45 degree surface 150, towards a focusing lens (or scan lens) system 125, which focuses deflected light beam 145 into an image point on photosensitive material 132. A high-speed motor 142 drives rotatable mirror 120 about a rotation axis 140.

As mirror 120 is rotated, beam 145 passes through scan lens system 125, causing a focused spot to move in a raster-like fashion along an imaging line 135 on material 132. The scan angles 0 that are swept out during imaging by the surface 150 span a range from approximately −32° to +32°. During this period, information contained in beam 145 exposes photosensitive material 132 in a sweep or scan-like manner. To produce the sweeping action of beam 145, motor 142 rotates mirror 120 at a pre-determined angular velocity. For a high-resolution scan, imaging line 135 is very fine (e.g., less than about 1/1000 of an inch wide). To scan an image field rapidly with such fine scan-beams, motor 142 typically turns mirror 120 at a high frequency (e.g., 20,000 revolutions per minute (RPM)).

Images are plotted by repetitive deflection of beam 145 where, for example, imaging line 135 is plotted in one beam deflection. Images are plotted as a successive plotting of imaging lines 135, wherein each imaging line 135 is made up of image elements known as pixels. More particularly, to expose the second dimension of photosensitive material 132, photosensitive material 132 can be translated in a direction perpendicular to imaging line 135 using techniques known in the art, such as a standard capstan roller. Alternatively, focused beam 158 can be translated perpendicular to imaging line 135 on photosensitive material 132 by, for example, using another movable mirror (not shown) positioned between scan lens system 125 and photosensitive material 132 to redirect beam 158. In addition, scan lens system 125 can be translated in a direction perpendicular to imaging line 135 using techniques known in the art, such as a flat bed Scan lens system 125 is constructed and arranged to focus beam 145 during scanning at all points along imaging line 135. In particular, scan lens system 125 can be an f-theta lens, i.e., it maintains the relationship $Y=f\times\theta$ where f is the effective focal length of the system, 74 is the scan angle, and Y is the distance of the imaged object along imaging line 135 from optical axis 98. An f-theta lens ensures that the scanning speed of beam 145 across the flat image field on photosensitive material 132 is uniform for a constant angular velocity of rotatable mirror 120.

In a scan lens system, such as scan lens system 125, that uses an f-theta lens, position errors occur when image pixels are not located at their ideal position on photosensitive material 132. For example, on imaging line 135, a pixel intended for position 135*a* may actually appear at position 135*b*. The distance between the actual position 135*b* and the intended position 135*a* is the position error. Sources of position error(s) can include: (a) scan lens system 125 design and/or assembly; (b) scan lens system 125 tilt (the scan lens system 125 is not ideally located in the path of beam 145); and (c) contributions of other optical and/or mechanical components positioned in the laser beam path that have non-ideal characteristics, and/or a non-ideal location of other optical and/or mechanical components in the laser beam path.

While position error is generally predictable for a given scan lens system 125 design, the actual position error produced by the scan lens system 125 can deviate from the predicted position error due, for example, to lens manufacturing tolerances and/or variations in other system components and alignments. It should be understood that position errors can also occur, for example, in drum type imaging systems, where such position errors are typically caused because the drum surface, or sections thereof, are not ideally located at the laser beam path.

One or more embodiments of the present invention is directed to systems and methods for reducing or eliminating position errors that occur in imaging systems.

SUMMARY OF THE INVENTION

In accordance with one embodiment of the present invention, a method of correcting scan position errors in an imaging system that can utilize a direct digital synthesizer (DDS) unit includes the steps of computing a nominal frequency tuning word, determining a number of corrections per scan line of an image, determining a next correction position, determining an image beam velocity error for the next correction position, determining a corrected frequency tuning word, and utilizing the corrected frequency tuning word to determine a pixel clock frequency for the next correction position.

Computing a nominal frequency tuning word can include the steps of generating a nominal linear scanning beam velocity by multiplying a rotational speed of an imaging system motor by an effective focal length of a scan lens assembly of the imaging system, and generating a nominal pixel clock frequency by multiplying the nominal linear scanning beam velocity by an image resolution. In addition, a formula can be applied relating an output frequency of a DDS unit, a system clock frequency of the DDS unit, and the nominal frequency tuning word, and the formula can be solved for the nominal frequency tuning word.

Also in accordance with an embodiment of the present invention, determining the number of corrections per scan line can include determining a frequency at which a memory of the DDS unit is driven, generating a first value by multiplying the frequency by the width of an image line, generating a second value by dividing the first value by the nominal linear scanning beam velocity, generating a third value by dividing the second value by the number of memory locations, generating a fourth value by rounding up of the third value to a nearest integer value, and determining a number of corrections per scan line of an image by dividing the second value by the fourth value.

The next correction position can be determined by first determining a correction spacing. The correction spacing, in turn, can be determined by generating a fifth value by multiplying the fourth value by the nominal linear scanning beam velocity to produce a product, and dividing the product by the frequency at which a memory of the DDS unit is driven. The next correction position can then be determined by adding the correction spacing to the current correction position.

The image beam velocity error at the next correction position can be determined by taking a derivative with respect to time of an image beam position error profile, and evaluating the derivative at the next correction position, thereby generating the image beam velocity error.

The corrected frequency tuning word can be determined by multiplying the nominal frequency tuning word by the sum of the image beam velocity error and 1.0, for the next correction position. The pixel clock frequency can be determined by accumulating phase information contained in the corrected frequency tuning words.

In another embodiment of the present invention, a method for correcting scan position errors in an imaging system can include determining an image beam velocity error as a function of a position within a scan line of an image, and using the image beam velocity error to determine a plurality of frequency tuning words used to generate a plurality of pixel clock frequencies to be respectively applied to a plurality of positions within the scan line. The method can further include performing an imaging operation in accordance with the plurality of pixel clock frequencies.

In yet another embodiment of the present invention, a system for correcting scan position error in an imaging system includes firmware for computing a nominal frequency tuning word used to control a rate of accumulation in a phase accumulator of a direct digital synthesizer (DDS) unit, determining a number of corrections per scan line of an image, determining a next correction position, determining an image beam velocity error for the next correction position, and determining a corrected frequency tuning word. The DDS unit utilizes the corrected frequency tuning word to determine a pixel clock frequency for the next correction position. The system can be, for example, an f-theta imaging system and/or a drum type imaging system.

In this system, the number of corrections per scan line can be determined by determining a frequency at which a memory of the DDS unit is driven, generating a first value by multiplying the frequency by the width of an image line, generating a second value by dividing the first value by a nominal image beam velocity, generating a third value by dividing the second value by a number of memory locations associated with the DDS unit, generating a fourth value by rounding up of the third value to a nearest integer value, and determining a number of corrections per scan line of an image by dividing the second value by the fourth value.

The system can include a laser for performing an imaging operation in accordance with the pixel clock frequency. The system can also include non-volatile storage containing firmware to perform at least the computing, a microprocessor to execute the firmware, and an interface unit to provide the corrected frequency tuning word to the DDS unit.

In still another embodiment of the present invention, a system for correcting scan position errors in an imaging system can include firmware for determining a plurality of image beam velocity errors as a function of a plurality of respective positions within a scan line of an image, and a direct digital synthesizer unit for utilizing data representative of the plurality of the image beam velocity errors to determine a plurality of pixel clock frequencies to be respectively applied to the plurality of respective positions within the scan line. The system can further include a laser for performing an imaging operation in accordance with the plurality of pixel clock frequencies. In addition, the system can include a microprocessor to execute the firmware, and an interface unit to provide the data representative of the plurality of beam velocity errors to the circuitry.

Determining the image beam velocity error can include taking a derivative with respect to time of an image beam position error profile, and evaluating the derivative at a next image beam correction position, thereby generating the image beam velocity error.

BRIEF DESCRIPTION OF THE DRAWINGS

The detailed description of the present application showing various distinctive features may be best understood when the detailed description is read in reference to the appended drawings in which.

DESCRIPTION OF THE INVENTION

Figure 1:
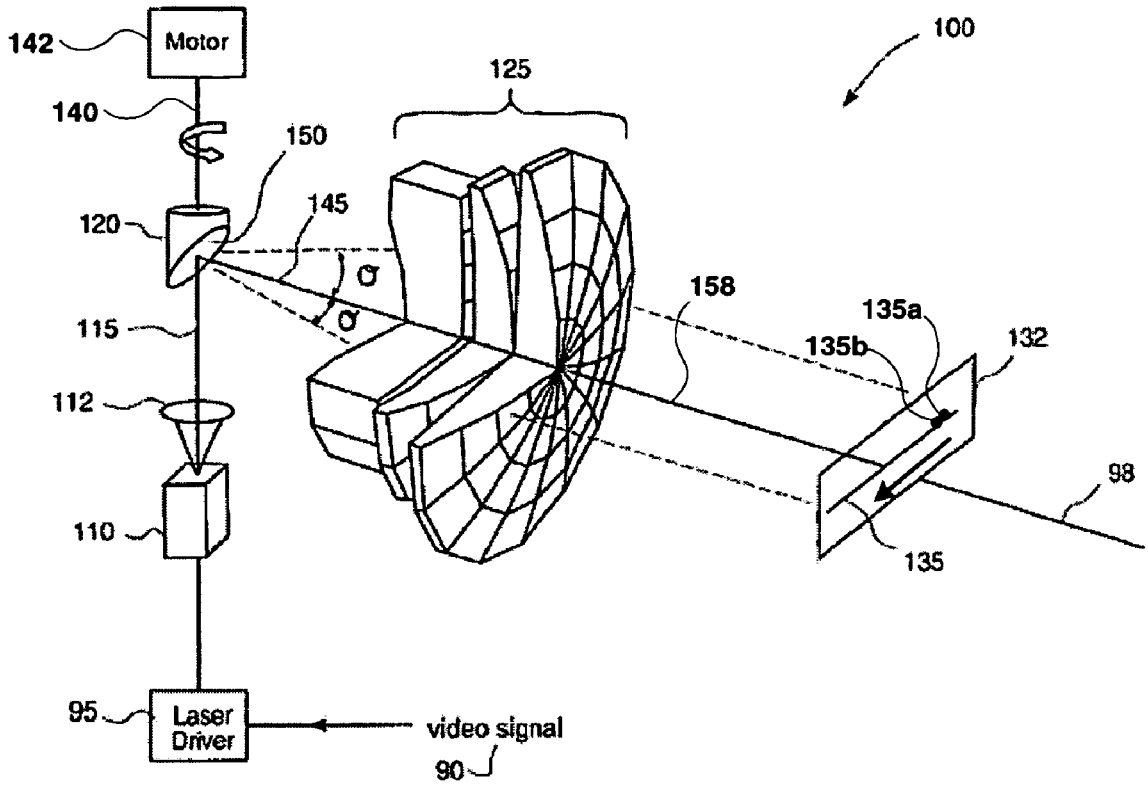
FIG. 1 is an illustration of a known flat field scanning system.
Figure 2:
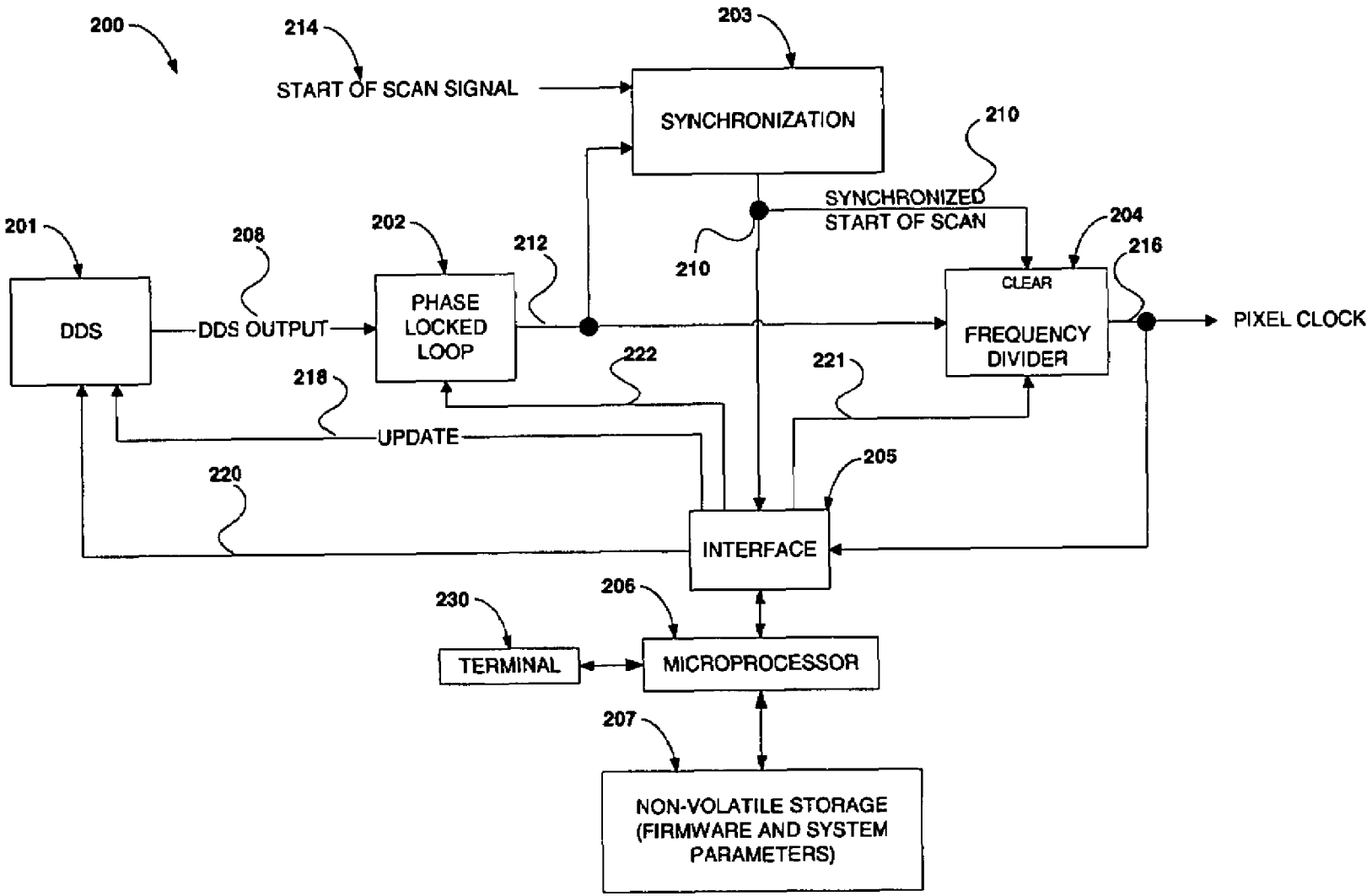
FIG. 2 is a block diagram of an exemplary system for correcting position errors in accordance with an embodiment of the present invention.

FIG. 2, generally at 200, is a block diagram of an exemplary system for correcting scan position errors in accordance with an embodiment of the present invention. FIG. 2 can thus be used, for example, in conjunction with system 100 shown in FIG. 1 to correct scan position errors. In particular, video signal 90 (FIG. 1) can be generated as a function of pixel clock frequency 216 (FIG. 2). As used herein, position error can be defined as the difference between the intended pixel position 135*a* and the actual pixel position 135*b*. Position error can be treated as a signed value, since the sign (positive or negative) can be used to indicate the direction of the error, and therefore the polarity of the required correction.

System 200 control is generally implemented and maintained by microprocessor unit 206 which, in one or more embodiments of the present invention, executes firmware stored in, for example, non-volatile storage 207. Microprocessor unit 206 can execute the firmware stored in non-volatile storage 207 to control the functions of system 100 that are not controlled by dedicated hardware. For purposes of position error correction, computations can be performed by microprocessor 206. Microprocessor unit 206 can also control other system functions, such as sequencing of motors, monitoring of sensors, user interface, and/or communication with a host computer (not shown).

In one or more embodiments of the present invention, non-volatile storage 207 can be, for example, standard flash memory that stores the firmware, and Static Random Access Memory (SRAM) that stores system 100 parameters such as laser power, optical efficiency of scan lens system 125 (i.e., the laser energy output from scan lens system 125 divided by the laser energy input to scan lens system 125), and scan position error data, as will be described herein. SRAM can be battery backed-up SRAM.

Interface 205 includes logic (e.g., circuitry) that enables microprocessor 206 to access and control direct digital synthesis (DDS) unit 201, phase locked loop (PLL) 202, and frequency divider 204. Interface 205 can include a standard parallel to serial converter that allows microprocessor 206 data to be serially transmitted to DDS unit 201. Interface 205 can be implemented, for example, as a standard Field Programmable Gate Array (FPGA) device. For example, interface 205 can be implemented as device XC2S200E from Xilinx, Inc., San Jose, Calif. The Spartan-IIE 1.8V FPGA Family: Complete Data Sheet, dated Jul. 28, 2004, Xilinx, Inc., San Jose, Calif., is incorporated herein by reference. Frequency divider 204 can be implemented as device SY100S834L from Micrel Incorporated, San Jose, Calif. The Micrel Incorporated SY100S834, SY100S834L (÷1, ÷2, ÷4) OR (÷2, ÷4, ÷8) Clock Generation Chip, Rev. F, Amendment/O, September 1999, is incorporated herein by reference. Microprocessor 206 can be implemented, for example, as device N80C196NT from Intel Corporation, Santa Clara, Calif.

Generally, a DDS unit, such as DDS unit 201, has the following basic blocks (not shown): a phase accumulator, a phase to amplitude converter (conventionally a sine ROM), a digital to analog converter, and a filter. A standard DDS unit works on the principle that a digitized waveform of a given frequency can be generated by accumulating phase changes at a higher frequency. The phase value stored in an input frequency register is added to the value in the phase accumulator once during each period of the system clock. The resulting phase value (from 0 to $2\pi$) is then applied to the sine lookup once during each clock cycle. The lookup converts the phase information to its corresponding sine amplitude. A digital to analog converter converts the sine amplitude information into a sinusoidal type signal. The sinusoidal type signal can be filtered and applied to a comparator to generate a digital signal at the output of the DDS unit. A DDS unit 201 such as model AD9954 from Analog Devices, Inc., Norwood, Mass., can be used with an external filter (not shown). Analog Devices 400 MSPS 14-Bit, 1.8 V CMOS Direct Digital Synthesizer AD9954 Product Data Sheet, Rev. 0, dated 2003, is incorporated herein by reference.

Output frequency 208 of DDS unit 201, which can be in the range, for example, of 50-66 MHz, is programmable (i.e., tunable) and can be a function, for example, of a 32 bit number, known as a frequency tuning word, that is applied to the phase accumulator of DDS unit 201. As used herein, a frequency tuning word is used to control the rate of accumulation in the phase accumulator of DDS unit 201. A series of frequency tuning words can be preloaded into DDS unit 201, and stored in its internal memory. This series of frequency tuning words can be used to correct position errors. A method for generating the frequency tuning words, and how they are used to correct position errors, will be discussed herein.

Output frequency 208 is converted to a higher frequency 212 by PLL 202. A PLL 202, such as device SY89421V from Micrel Incorporated, San Jose, Calif., can be used. The Micrel Incorporated SY89421V, 5V/3.3V, High-Performance, Phase Locked Loop Data Sheet, dated 2000, is incorporated herein by reference.

PLL 202 can operate in different modes and is controlled by one or more signal 222, received from interface unit 205. Signal 222 can represent parameters, such as multiplication factors, internal to PLL 202, to produce a higher output frequency 212. In at least one embodiment of the present invention, PLL 202 generates a frequency 212 in the range, for example, of 600 MHz to 1 GHz.

PLL 202 output frequency 212 is supplied to synchronization unit 203 and frequency divider 204. A synchronization unit 203, such as device MC100EP142 from ON Semiconductor Corp. (Semiconductor Components Industries, LLC), Phoenix, Ariz., can be utilized. The ON Semiconductor Corp. (Semiconductor Components Industries, LLC), MC10EP142, MC100EP142 3.3V/5V, ECL 9-Bit Shift Register Data Sheet, November, 2004-Rev. 13, is incorporated herein by reference. An external start of scan signal 214, which can be generated from a standard optical encoder (not shown) of motor 142, is also supplied to synchronization unit 203. Start of scan signal 214 can be a synchronization pulse that indicates the start position of a laser beam sweep. Start of scan signal 214 is generated once per beam deflection sweep (i.e., once for each imaging line 135) at a frequency of, for example, 533 Hz. Start of scan signal 214 can generally range from 100 Hz to 1200 Hz depending, for example, on motor 142 speed, which in turn can depend, for example, on image resolution, laser 95 power, and media exposure requirements. Another type of external sensor that can be used is a standard phototodetector device positioned in the path of beam 158, prior to image line 135.

Synchronization unit 203 provides as output a synchronized start of scan signal 210 that is synchronized to frequency 212. Synchronized start of scan signal 210 is provided as input to frequency divider 204 and interface 205. Synchronized start of scan signal 210 causes frequency divider 204 to start by releasing, for example, a standard CLEAR control input. Frequency divider 204 divides frequency 212 to generate pixel clock frequency 216. Interface 205 provides control signals 221 to enable microprocessor 206 control over selection of the divider ratio utilized by frequency divider 204, in order to achieve a desired pixel clock frequency 216. The value of the divider ratio is determined by microprocessor 206, as will be discussed herein.

Synchronization unit 203 and frequency divider, 204 are thus utilized to generate a desired pixel clock frequency 216 that is synchronized to start of scan signal 214. This is desirable in order to ensure that the first (and other) pixel(s) is at the same start position from scan line to scan line, with a precision of one cycle of output frequency 212. In one or more embodiments of the present invention, pixel clock frequency 216 is in the range, for example, of 80 MHz to 250 MHz.

Frequency tuning words are determined by executing an algorithm, prior to imaging operations, as will be explained in connection with FIG. 3 and FIG. 5. The algorithm can be implemented in firmware, which can be stored in non-volatile storage unit 207, and executed by microprocessor 206.

Prior to imaging operations, frequency tuning words, as part of data 220, are transmitted from microprocessor 206 to interface unit 205, and serially clocked into the internal memory of DDS unit 201. In addition, control register data such as the frequency of DDS unit 201 clock and the number of DDS unit 201 clock cycles per correction, can also be transmitted as data 220 and serially clocked into DDS unit 201. Interface unit 205 implements the parallel to serial conversion that allows the various selected microprocessor 206 data to be serially input into DDS unit 201. This allows microprocessor 206 to configure DDS unit 201, prior to imaging, such that during imaging DDS unit 201 is configured to adjust pixel clock frequency 216 in the manner as described below.

During an imaging operation, synchronized start of scan signal 210 and pixel clock frequency 216 are provided to interface 205, which generates update signal 218. Update signal 218, which can be generated once per beam sweep, prompts DDS unit 201 to begin sequentially applying the frequency tuning words (that are included in data 220 and pre-stored in DDS unit 201 memory) to the internal accumulator of DDS unit 201. DDS unit 201 sequentially applies the frequency tuning words as beam 158 is swept across imaging line 135. As each frequency tuning word is sequentially supplied to the internal accumulator of DDS unit 201, DDS unit 201 adjusts (i.e., changes the frequency of) output frequency 208 during the beam sweep. Output frequency 208 can be changed at a rate based on, for example, the amount of random access memory (RAM) in DDS unit 201 and an algorithm stored, for example, in non-volatile storage 207, as will be explained in connection with FIG. 5.

As output frequency 208 is adjusted during the beam sweep, PLL 202 output frequency 212 is also adjusted (i.e., changed) in a similar (e.g., linear) manner as it is responds to output frequency 208. Similarly, pixel clock frequency 216 is also adjusted (i.e., changed) as it tracks PLL 202 output frequency 212. The manner in which pixel clock frequency 216 is adjusted is therefore controlled by the frequency tuning words in DDS unit 201 memory.

During a beam sweep that would generate imaging line 135 (FIG. 1), the placement of pixels on imaging line 135 is a function of pixel clock frequency 216. By adjusting pixel clock frequency 216, under control of the frequency tuning words in DDS unit 201 memory as described above, the pixel spacing is adjusted during imaging on photosensitive material 132. Pixel spacing is adjusted to reduce or eliminate pixel placement position errors caused by, for example, the optical components in imaging system 100. We have discovered that although position errors may exhibit variations in scale, rotation, and symmetry, they generally vary slowly and smoothly across a scan line, such as imaging line 135. In one or more embodiments of the present invention, position errors are corrected to within 50 microns or less, which is a reduction that generally ranges from a factor of two to at least an order of magnitude.

System 200 can be implemented at a variety of different spinning mirror 120 rotation speeds, image resolutions and image locations, and in various combinations thereof. In one embodiment of the present invention, system 200 can be used to optimally correct for media and corresponding images that vary continuously in size from 4.5 inches to 45 inches and/or generate images of resolutions of about 6000 dots/inch. Other embodiments of the present invention can be used with images whose resolutions vary from one image to the next.

As stated previously, the frequency tuning words are determined by a program stored as firmware in non-volatile storage 207, to be executed by microprocessor 206. The program algorithms will now be explained in connection with FIGS. 3 and 5.

Figure 3:
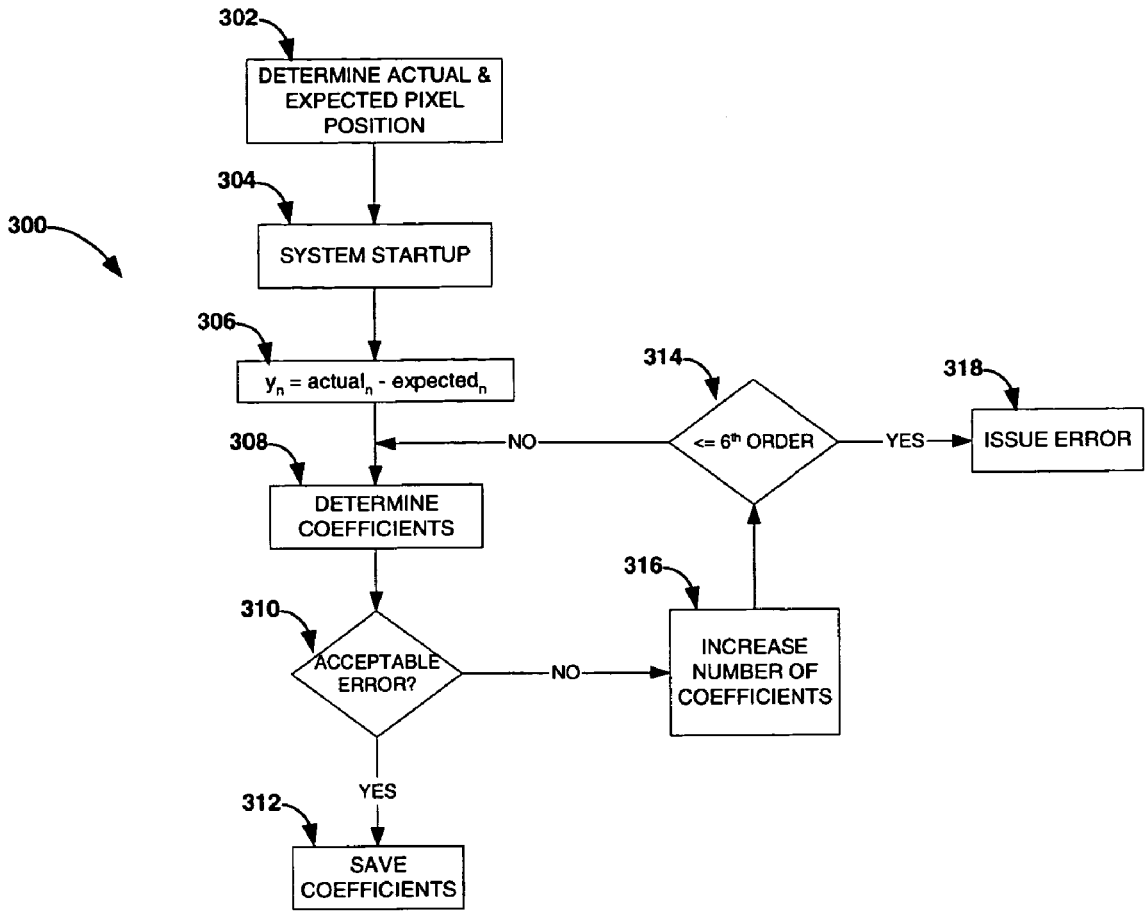
FIG. 3 is a flow diagram in accordance with an exemplary embodiment of the present invention, illustrating a method of fitting a polynomial to position error data.
Figure 4:
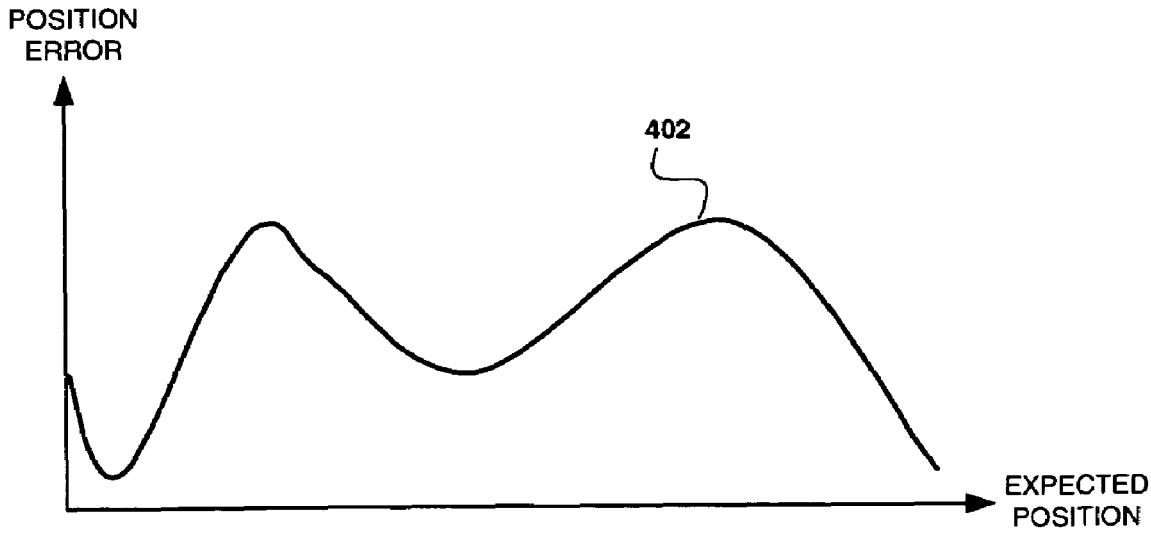
FIG. 4 is an exemplary position error profile.

FIG. 3, generally at 300, is a flow diagram in accordance with an exemplary embodiment of the present invention, illustrating a method of fitting a polynomial to position error data. The method of FIG. 3 is generally performed at system 200 startup. FIG. 4, generally at 400, is an exemplary position error profile, where the x-axis represents the expected (intended) pixel position 135*a* of the target pixel with respect to a reference point, and the y-axis represents the error at that position (i.e., the difference between the intended pixel position 135*a* and the actual pixel position 135*b*).

In general, polynomial 402 takes the following form:

$$y=\alpha_0+\alpha_1x+\alpha_2x^2+\alpha_3x^3+\alpha_4x^4+\alpha_5x^5$$

The order of polynomial 402 is generally dependent on the scan lens system 125 and system 100 design, and will typically range from $2^{nd}$ order to $6^{th}$ order. The polynomial "fitting" can be accomplished using, for example, a standard least squared error algorithm to find the coefficients, $\alpha_0$–$\alpha_5$. In order to accommodate alternate scan lens system 125 and/or system 100 designs, a method in accordance with the present invention iteratively attempts to fit a polynomial 402 (FIG. 4) to the position error data, using a progressively larger number of coefficients until, for example, a polynomial 402 is determined that has a least squared error that satisfies acceptability criteria with respect to position error. In most cases, the polynomial fitting can be accomplished using IEEE standard 754 single or double precision floating point math. Some cases, however, may require the use of arbitrary precision math in order to satisfy desired acceptability criteria.

Polynomial 402 coefficients can be stored, for example, in microprocessor memory, and be recomputed if position error data changes. For example, prior to each image, the expected and actual position values are checked against the values that were used to compute the polynomial coefficients at startup. If any of the position values have changed, the algorithm of FIG. 3 can be run (again) to determine a new set of coefficients.

Returning now to FIG. 3, initially, at step 302, actual and expected pixel position data is determined. For example, an image containing targets in known locations can be plotted by an imaging system, such as system 100, and the position of each target is measured by, for example, a technician. The technician then enters the position data and position error data for each target into system 200 via, for example, terminal 230, as pairs of values: an expected position and an actual position. As part of this process, data may be collected by a system such as the VideoMic®, manufactured by Operations Technology, Inc, Blairstown, N.J. Such data may be provided to non-volatile storage 207 using, for example, terminal 230. Terminal 230 can be a standard keyboard and monitor used in connection with a general purpose computer. Microprocessor 206 writes the position data and position error data into non-volatile storage 207.

When system 200 is started, at step 304 microprocessor 206 reads the expected and actual position data from non-volatile storage 207. At step 306, microprocessor 206 computes the position error of each target and creates a set of (x,y) pairs with, for example, x representing the expected position of the target and y representing the error at that position.

At step 308, microprocessor 206 determines coefficients of a polynomial by attempting to fit the polynomial to the set of (x,y) values. The order of the required polynomial will generally depend on various criteria (discussed above), such as scan lens system 125 design, and range, for example, from $2^{nd}$ order to $6^{th}$ order.

At decision step 310, microprocessor 206 determines if the error in fitting polynomial 402 to the measured data is acceptable. Acceptability criteria may be stored in non-volatile storage 207. If, at decision step 310, it is determined that the fitting error is not acceptable, then, at step 316, the order of polynomial 402 is increased by increasing the number of coefficients. If, at decision step 310, it is determined that the fitting error is acceptable, then, at step 312, the coefficients are saved, for example, in microprocessor 206 memory, and the process terminates. In other embodiments of the present invention, coefficients can be stored in non-volatile storage, or in a combination of microprocessor 206 memory and non-volatile storage.

At decision step 314, step 308 is repeated if the order of polynomial 402 is less than or equal to $6^{th}$ order. If, at decision step 314 it is determined that polynomial 402 is a $7^{th}$ order polynomial or greater, an error can be issued at step 318. In one or more embodiments of the present invention, the error issued will typically indicate one or more errors in measurement or data entry. In other embodiments of the present invention, polynomial 402 can, however, be $7^{th}$ order or greater depending, for example, on a need for increased accuracy.

Polynomial 402 thus represents the position error profile, and can be used to interpolate as many correction points desired between measurements. As is common in imaging systems such as system 100, scan position errors tend to be greater near the start and end of imaging line 135. Advantageously, in accordance with one or more embodiments of the present invention, polynomial 402 can be used, for example, to extrapolate corrections within as well as outside of the image area, without making measurements close to the edge of material 132.

Figure 5:
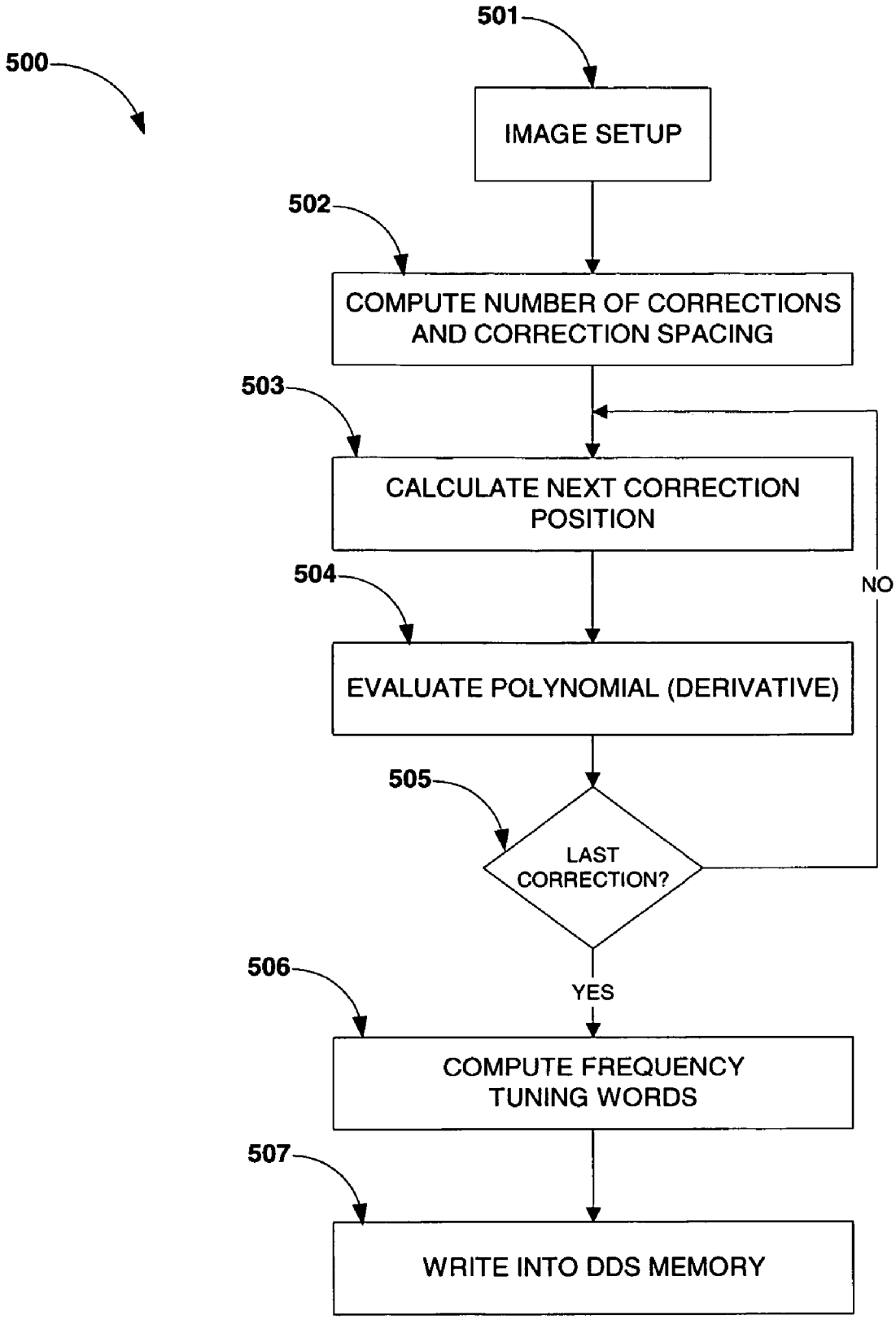
FIG. 5 is a flow diagram in accordance with an exemplary embodiment of the present invention, illustrating a method of reducing or eliminating position error.

FIG. 5, generally at 500, shows an exemplary method of reducing or eliminating position errors in accordance with an embodiment of the present invention. For each image plotted on material 132, system 200 can determine, at step 501, the rotational speed of motor 142 based on system parameters such as the optical efficiency of system 100, the power of the beam emanating from laser driver 95, and the exposure requirements of material 132. As used herein, exposure requirements refer to the amount of light energy required to properly expose the photosensitive material. Unlike photographic film, where the exposure requirements are fairly standardized, the exposure requirements for printing plates can vary substantially. An operator will therefore generally provide instruction to a system (e.g., system 100) indicating what type of plates are being used, and their exposure sensitivity, so that the firmware can initialize the system to deliver the correct amount of energy to the plate. System parameters can be stored in non-volatile storage 207.

Multiplying the rotational speed of motor 142, in radians per second, by the effective focal length of scan lens assembly 125 yields the nominal linear velocity of scanning beam 158 at image line 135, hereafter referred to as beam velocity. The beam velocity, in inches per second, is then multiplied by the image resolution, in pixels per inch, to obtain the nominal pixel clock frequency 216, expressed in pixels per second, or Hz. Microprocessor 206 then computes the nominal DDS frequency tuning word and PLL 202 multiplication factor required to generate this pixel clock frequency 216. For example, PLL 202 multiplication factor can be selected by testing each of the possible multiplier values, starting with the smallest, until one is found that will give output frequency 208 that is within the input frequency range of the PLL 202 and within the output frequency range of the DDS unit 201. Once a suitable multiplication factor is determined, the nominal frequency tuning word can be calculated according to a formula provided in a data sheet that will accompany a standard DDS unit 201 (e.g., a data sheet that is supplied with a DDS unit 201 such as the AD9954). For example, the Analog Devices 400 MSPS 14-Bit, 1.8 V CMOS Direct Digital Synthesizer AD9954 Product Data Sheet, Rev. 0, dated 2003, incorporated herein by reference, provides the following formulas:

$$f_o=(FTW)(f_s)/2^{32} \text{ with } 0\leqq FTW\leqq 2^{-}, \text{ and}$$

$$f_o=(f_s)\times(1-(FTW/2^{32})) \text{ with } 2^{31}\leqq 2^{32}-1$$

Thus, for known output frequency 208 (corresponding to $f_o$) and the DDS system clock, SYSCLK (corresponding to $f_s$), the frequency tuning word (FTW) can be computed.

At step 502, microprocessor 206 computes the number of corrections per scan line and the correction spacing, as will be described herein. As used herein, correction spacing is the linear distance between corrections on scan line 135. For example, if there are 128 corrections on an 8 inch horizontal image area, then the correction spacing is 1/16 inch. DDS unit 201 internal timing circuitry can generate a constant frequency clock known as SYNC_CLK, which is at ¼ of the SYSCLK frequency. The SYNC_CLK frequency is utilized to synchronize DDS unit 201 internal RAM timing with the DDS phase accumulator and update signal 218. An integer value called RAMP_RATE defines the rate at which the internal RAM address will advance, expressed in SYNC_CLKs. In other words, the frequency tuning word values stored in DDS unit 201 internal RAM will be sequentially applied to the phase accumulator, with each one being used for the number of SYNC_CLKs defined by the RAMP_RATE value. The frequency of SYNC_CLK divided by the beam velocity and multiplied by the width of image line 135 yields the number of SYNC_CLKs per scan line. This value is then divided by the number (or size) of RAM locations (e.g., $2^{10}$=1024 words of RAM), and rounded up to the next larger integer value to find the RAMP_RATE. The number of corrections per scan line is the number of SYNC_CLKs per scan line divided by the RAMP_RATE. The SYSCLK, SYNC_CLK and RAMP_RATE parameters are referenced in Analog Devices 400 MSPS 14-Bit, 1.8 V CMOS Direct Digital Synthesizer AD9954 Product Data Sheet, Rev. 0, dated 2003.

The correction spacing can be determined by multiplying the RAMP_RATE by the beam velocity, and dividing the product by the SYNC_CLK frequency. The distance between corrections is needed because DDS unit 201 is operating in the time domain, and sequencing through the RAM values at fixed time intervals as determined by the SYNC_CLK and RAMP_RATE. However, the measured position error data is in the spatial domain, so it is necessary to correlate the time domain information with the spatial domain in order to determine the error at each correction point, i.e., each time a new frequency tuning word is selected. The current position is set to zero, corresponding to the start of scan location.

At step 503, the position of the next correction is determined by adding the correction spacing found in step 502 to the current position. This value becomes the new current position.

Figure 6:
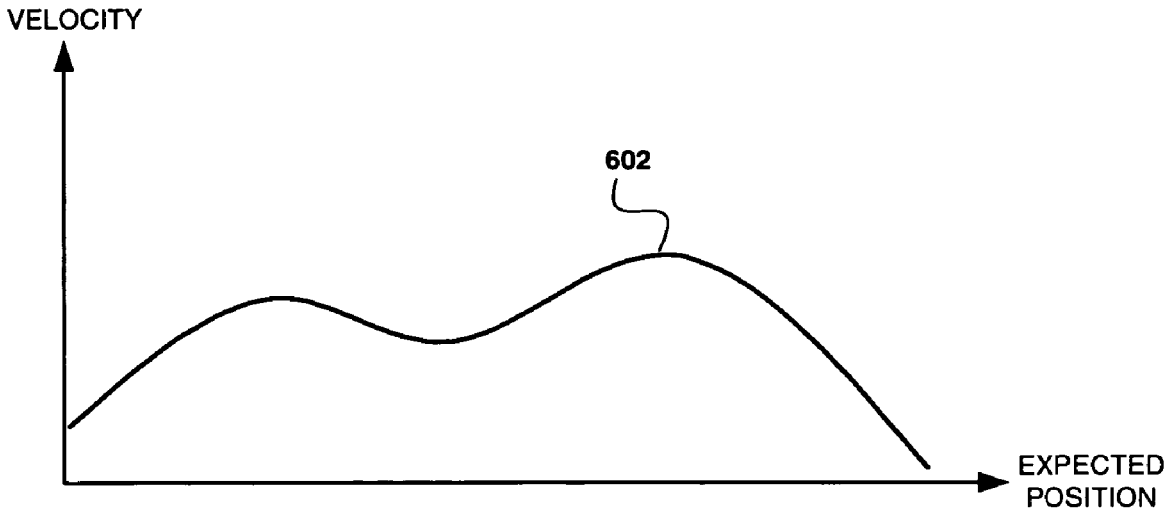
FIG. 6 is an exemplary velocity error profile.

At step 504, polynomial 402 is evaluated to find the error at the current position. Polynomial 402 represents the error in beam position. However, what is needed is the error in beam velocity. This is because the adjustable parameter is DDS unit 201 output frequency 208, which is analogous to beam velocity. Evaluating the derivative of polynomial 402 with respect to time at the position determined in step 503 yields the error in beam velocity at that point. The beam velocity error is added to 1.0, and saved as a correction factor for this position. FIG. 6, generally at 600, is an exemplary beam velocity profile, where the x-axis represents the expected position of the target pixel, and the y-axis represents the error in the actual beam velocity at that position. The beam velocity profile 602 can be determined by taking the derivative with respect to time of the position error profile of FIG. 4.

If, at decision step 505, it is determined that system 200 has not computed correction factors for the number of corrections per scan line 135 determined in step 502, the method returns to step 503 to calculate the next correction spacing. If at decision step 505, it is determined that system 200 has computed correction factors for the number of corrections per scan line determined in step 502, the method proceeds to step 506.

At step 506, each of the correction factors determined in step 504 is multiplied by the nominal frequency tuning word value determined in step 501 to produce respective corrected frequency tuning words. The resulting corrected frequency tuning words are then written into the DDS unit 201 memory at step 507.

Other embodiments of the invention can include the following steps. Subsequent to applying the correction algorithm as described in FIG. 5, a material 132 is imaged, and measured for scan position error as previously described. While position errors will be reduced, they may not be reduced to zero. An approach to reducing the residual error is to perform a second pass correction. In particular, the second pass correction is performed by modifying the frequency tuning words used in the first pass, based on the residual measured errors. Thus, for each correction point, the original measured actual position value is adjusted by the residual error at that point, either adding or subtracting depending on the direction of the additional residual error. These adjusted values are then entered as the correction data used to compute new frequency tuning words. This process could be performed iteratively, with each repetition further reducing position errors.

Other embodiments of the invention can be used to correct for scan position errors in an input scanning system. For these systems, position error data would be generated by scanning a known accurate target and processing the scanned image data. The position error data is then entered and used in the same manner as in the imaging system application.

The many features and advantages of the invention are apparent from the detailed specification, and thus, it is intended to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention. While the foregoing invention has been described in detail by way of illustration and example of preferred embodiments, numerous modifications, substitutions, and alterations are possible. For example, since scan position errors can also occur in drum type imaging systems, where scan position errors are typically caused because the drum surface, or sections thereof, are not ideally located at the laser beam path, the present invention contemplates that one or more embodiments thereof can also be utilized in connection with drum-type imaging systems.

Having thus described our invention, what we claim as new and desire to secure by Letters Patent is as follows:

1. A method of correcting scan position errors in an imaging system comprising a direct digital synthesizer (DDS) unit, comprising:

(a) computing a nominal frequency tuning word used by the DDS unit;

(b) determining a number of corrections per scan line of an image;

(c) determining a next correction position;

(d) determining an image beam velocity error for the next correction position;

(e) determining a corrected frequency tuning word;

(f) utilizing the corrected frequency tuning word to determine a pixel clock frequency for the next correction position;

wherein computing a nominal frequency tuning word step (a) comprises:

(g) generating a nominal linear scanning beam velocity by multiplying a rotational speed of an imaging system motor by an effective focal length of a scan lens assembly of the imaging system;

(h) generating a nominal pixel clock frequency by multiplying the nominal linear scanning beam velocity by an image resolution; and (i) applying a formula relating an output frequency of the DDS unit, a system clock frequency of the DDS unit, and the nominal frequency tuning word; and (j) solving the formula for the nominal frequency tuning word.

2. The method according to claim 1, wherein determining the number of corrections per scan line step (b) comprises:

(k) determining a frequency at which a memory of the DDS unit is driven;

(l) generating a first value by multiplying the frequency of step (k) by the width of an image line;

(m) generating a second value by dividing the first value of step (l) by the nominal linear scanning beam velocity generated in step (g);

(n) generating a third value by dividing the second value of step (m) by a number of memory locations associated with step (k);

(o) generating a fourth value by rounding up of the third value of step (n) to a nearest integer value; and (p) determining a number of corrections per scan line of an image by dividing the second value of step (m) by the fourth value of step (o).

3. The method according to claim 2, wherein determining a next correction position step (c) comprises:

determining a correction spacing comprising:

(q) generating a fifth value by multiplying the fourth value of step (o) by the nominal linear scanning beam velocity to produce a product, and dividing the product by the frequency in step (k); and (r) adding the fifth value to a current correction position.

4. The method according to claim 3, wherein determining the image beam velocity error at the next correction position step (d) comprises:

(s) taking a derivative with respect to time of an image beam position error profile; and (t) evaluating the derivative at the next correction position, thereby generating the image beam velocity error.

5. The method according to claim 4, wherein determining a corrected frequency tuning word step (e) comprises the step multiplying the nominal frequency tuning word by the sum of the image beam velocity error and 1.0, for the next correction position.

6. The method according to claim 5, wherein the pixel clock frequency is determined by accumulating phase information contained in the corrected frequency tuning words.

7. A system for correcting scan position error in an imaging system, comprising: firmware for:

computing a nominal frequency tuning word used to control a rate of accumulation in a phase accumulator of a direct digital synthesizer (DOS) unit;

determining a number of corrections per scan line of an image;

determining a next correction position;

determining an image beam velocity error for the next correction position; and determining a corrected frequency tuning word;

wherein the DOS unit utilizes the corrected frequency tuning word to determine a pixel clock frequency for the next correction position, wherein determining the number of corrections per scan line comprises:

determining a frequency at which a memory of the DOS unit is driven;

generating a first value by multiplying the frequency by the width of an image line;

generating a second value by dividing the first value by a nominal image beam velocity;

generating a third value by dividing the second value by a number of memory locations associated with the DDS unit;

generating a fourth value by rounding up of the third value to a nearest integer value; and determining a number of corrections per scan line of an image by dividing the second value by the fourth value.

8. A system for correcting scan position errors in an imaging system, comprising:

firmware for determining a plurality of image beam velocity errors as a function of a plurality of respective positions within a scan line of an image; and a direct digital synthesizer unit for utilizing data representative of the plurality of the image beam velocity errors to determine a plurality of pixel clock frequencies to be respectively applied to the plurality of respective positions within the scan line, wherein determining the image beam velocity error comprises: taking a derivative with respect to time of an image beam position error profile; and evaluating the derivative at a next image beam correction position, thereby generating the image beam velocity error.

* * * * *